US012685889B2

(12) United States Patent
Hsu

(10) Patent No.: US 12,685,889 B2
(45) Date of Patent: Jul. 21, 2026

(54) ELECTRIC LOCKING STRUCTURE FOR RESISTANCE MOTOR OF EXERCISE MACHINE

(71) Applicant: Chih-Yung Hsu, Tainan City (TW)

(72) Inventor: Chih-Yung Hsu, Tainan City (TW)

( * ) Notice: Subject to any disclaimer, the term of this patent is extended or adjusted under 35 U.S.C. 154(b) by 183 days.

(21) Appl. No.: 18/621,477

(22) Filed: Mar. 29, 2024

(65) Prior Publication Data

US 2025/0090888 A1 Mar. 20, 2025

(30) Foreign Application Priority Data

Sep. 18, 2023 (TW) ..... 112210068

(51) Int. Cl.

| | |
|---|---|
| ***A63B 21/005*** | (2006.01) |
| ***A63B 21/00*** | (2006.01) |
| ***A63B 24/00*** | (2006.01) |
| *A63B 71/00* | (2006.01) |

(52) U.S. Cl.

CPC ..... *A63B 21/0058* (2013.01); *A63B 21/153* (2013.01); *A63B 24/0087* (2013.01); *A63B 2071/0081* (2013.01)

(58) Field of Classification Search

CPC ..... A63B 21/0058; A63B 21/153; A63B 24/0087; B65H 75/4431; B65H 2403/70

See application file for complete search history.

(56) References Cited

U.S. PATENT DOCUMENTS

| | | | | |
|---|---|---|---|---|
| 5,360,382 | A * | 11/1994 | Chi | A63B 21/0058 482/99 |
| 9,327,160 | B2 * | 5/2016 | Tauriainen | A63B 21/0783 |
| 10,307,631 | B2 * | 6/2019 | Jeremic | A63B 22/0076 |
| 2019/0105526 | A1 * | 4/2019 | Boatwright | A63B 21/06 |
| 2020/0070032 | A1 * | 3/2020 | Orady | H02P 3/22 |
| 2025/0288843 | A1 * | 9/2025 | Nayak | A63B 21/154 |

FOREIGN PATENT DOCUMENTS

| | | | | |
|---|---|---|---|---|
| DE | 102023104358 | A1 * | 8/2024 | A47L 9/26 |
| KR | 200205440 | Y1 * | 12/2000 | B65H 75/4431 |
| TW | M632778 | U | 10/2022 | |

* cited by examiner

*Primary Examiner* — Joshua T Kennedy

(74) *Attorney, Agent, or Firm* — Rosenberg, Klein & Lee

(57) ABSTRACT

An electric locking structure for a resistance motor of an exercise machine, includes a frame; a resistance motor having an output shaft for outputting a resistance force; a rotary disk connected to the output shaft; a locking disk connected to the output shaft and having a plurality of locking spaces; a traction member for pulling the rotary disk to overcome the resistance force; a locking bolt, movably disposed on the frame; an electric control unit, connected to the locking bolt; and a power storage unit, electrically connected to the electric control unit. The electric locking structure can prevent the traction member from being pulled out arbitrarily and not being able to be retracted.

17 Claims, 8 Drawing Sheets

ELECTRIC LOCKING STRUCTURE FOR RESISTANCE MOTOR OF EXERCISE MACHINE

FIELD OF THE INVENTION

The present invention relates to a locking device, and more particularly to an electric locking structure for a resistance motor of an exercise machine, which can prevent a traction member of the exercise from being pulled out arbitrarily and not being able to be retracted when the exercise machine is stationary.

BACKGROUND OF THE INVENTION

In general, a conventional exercise machine uses the rotating shaft of a motor to generate a resistance force when the rotating shaft is rotated to reel in a cable. The resistance force is used as a source of weight for strength training, thereby training the muscles of various parts of the body. For example, in rope pull training, when the power of the motor is turned off, the rotating shaft stops rotating for coiling the cable. Once the cable is pulled by hand, the cable can't be coiled to return its original position without power, thus causing obstruction and disturbance in use.

As disclosed in Taiwan Utility Model Publication No. M632778, titled "PULL ROPE RESISTANCE MECHANISM FOR EXERCISE MACHINE" published on Oct. 1, 2022, the pull rope resistance mechanism includes a drive unit, a pull rope, and a brake unit. The drive unit has a motor and a reel connected to the motor. One end of the pull rope is connected to the reel so that the pull rope can be pulled by the reel and coiled around the reel. The brake unit has a brake member located close to the reel. When the brake member is in the brake position to be in contact with the reel, the reel won't be rotated when the motor is turned off. When the brake member is in the release position without contacting the reel, the reel will be driven by the motor to rotate. In this way, the pull rope resistance mechanism can prevent the pull rope from being easily pulled out after the motor is turned off.

The pull rope resistance mechanism uses friction force to prevent the pull rope from being pulled out. When the force of pulling the pull rope is greater than the friction force, the pull rope will be pulled out. In particular, after a period of use, the brake member of the brake unit will become worn, so the friction force will be weakened. It is impossible to prevent the pull rope from being pulled out effectively. Therefore, it is not ideal for use.

SUMMARY OF THE INVENTION

In order to solve the above-mentioned shortcomings of the conventional exercise machine, the primary object of the present invention is to provide an electric locking structure for a resistance motor of an exercise machine. The electric locking structure comprises a frame, a resistance motor, a rotary disk, a locking disk, a traction member, a locking bolt, an electric control unit, and a power storage unit. The resistance motor is fixed to the frame. The resistance motor has an output shaft for outputting a resistance force. The rotary disk is connected to the output shaft. The locking disk is connected to the output shaft. The locking disk has a plurality of locking spaces. The traction member is coiled on the rotary disk for pulling the rotary disk to overcome the resistance force. The locking bolt is movably disposed on the frame. The electric control unit is connected to the locking bolt. The power storage unit is electrically connected to the electric control unit. When the resistance motor is stationary, the electric control unit selectively moves the locking bolt to be in or out of any one of the locking spaces for restricting or releasing the output shaft to lock or unlock the resistance motor.

Preferably, the electric control unit is one of a control motor and a solenoid valve.

Preferably, the electric control unit includes an axle, a control disk fixed to the axle, and a cable. The control disk is connected to the locking bolt through the cable for moving the locking bolt to be in or out of any one of the locking spaces.

Preferably, the locking bolt is disposed in a retaining seat. The retaining seat is fixed to the frame. The locking bolt includes a stop ring fitted on a periphery of the locking bolt and a return spring on a rear section of the locking bolt behind the stop ring. The return spring is elastically held between the stop ring and an inner wall of the retaining seat.

Preferably, the cable includes a first cable and two second cables. One end of the first cable is connected to the control disk. One end of each of the second cables is connected to the rear section of the locking bolt. Another end of the first cable and another end of each of the second cables are oppositely connected to a linking block, respectively.

Preferably, the locking bolt is parallel to the output shaft.

Preferably, the locking disk is independently coupled to the rotary disk or integrally formed with the rotary disk.

Preferably, the locking spaces are axial through holes of the locking disk or grooves formed on a circumference of the locking disk.

Preferably, the locking spaces are arranged on the locking disk around the output shaft.

Preferably, the traction member is one of a pull cable, a webbing and a pull rope.

According to the above technical features, the present invention can achieve the following effects:

1. Through the elastic restoring force from the return spring, the locking bolt can be moved out to be engaged in any one of the locking spaces of the locking disk. The locking disk is locked by the locking bolt to limit the rotation of the output shaft, so that the resistance motor is locked, thereby preventing the traction member from being pulled out arbitrarily.

2. When the resistance motor of the exercise machine is stopped and stationary, the coiled traction member will not be pulled out arbitrarily, without the disadvantage of not being able to be retracted. Besides, it will not be pulled out in such a way as to cause obstruction or disturbance.

3. The present invention uses a single electric control unit. Through the linkage of the linking block, one first cable can link two or more second cables. Therefore, the number of linking components can be effectively reduced, so that the overall structure can be simplified.

4. The power storage unit with small current supplies the power required for the operation of the electric control unit. Therefore, it is extremely energy efficient when used.

DESCRIPTION OF THE PREFERRED EMBODIMENTS

Embodiments of the present invention will now be described, by way of example only, with reference to the accompanying drawings.

In the following embodiments of the present invention, spatially relative terms, such as "left," "right," "front," "rear," "upper," "low," and the like, may be used herein for ease of explanation to describe one element or feature's relationship to another element(s) or feature(s) as illustrated in the figures when the user A (referring to FIG. 7) sits on the seat portion 11 of the frame 1 of the present invention.

Figure 1:
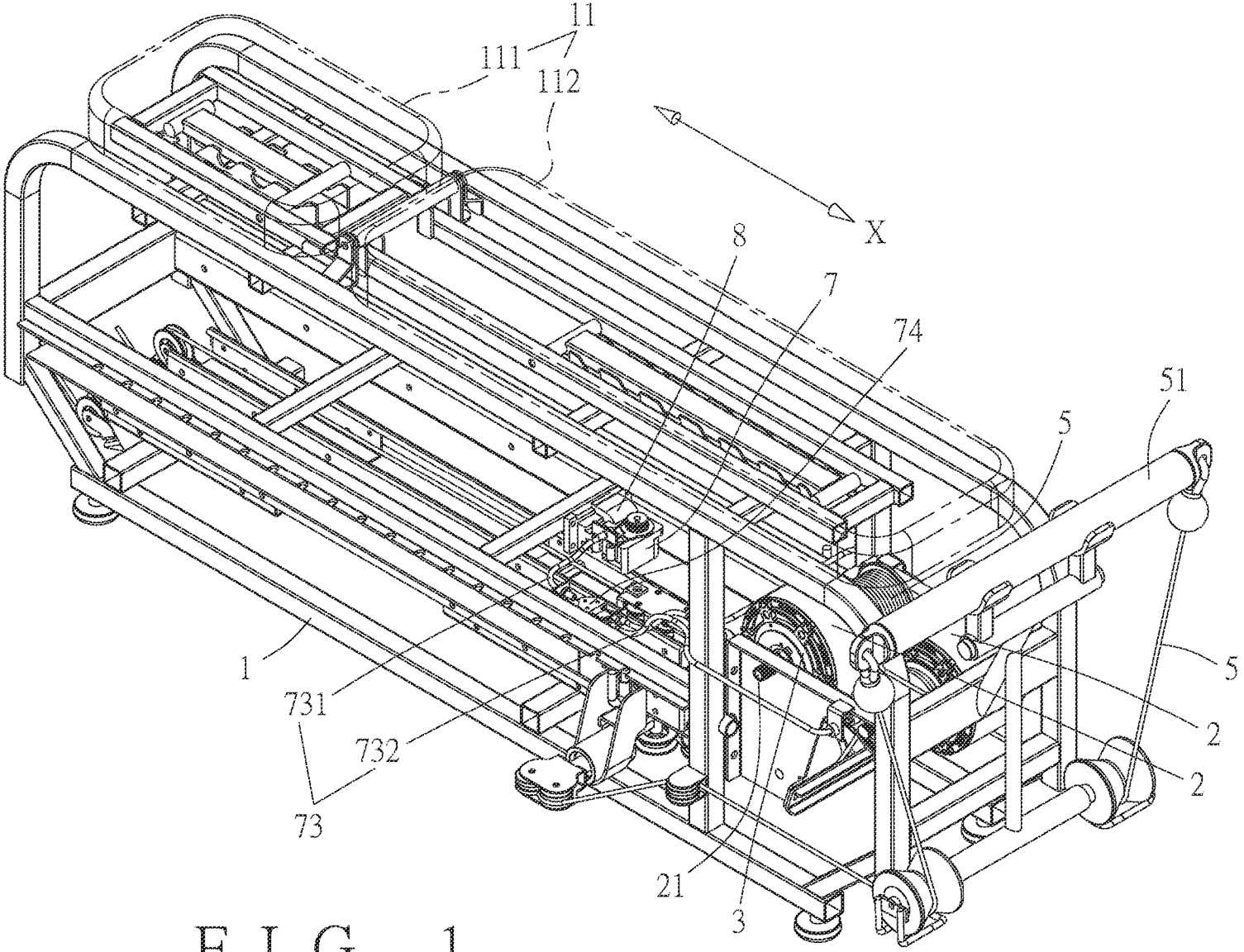
FIG. 1 is a perspective view according to an embodiment of the present invention.
Figure 2:
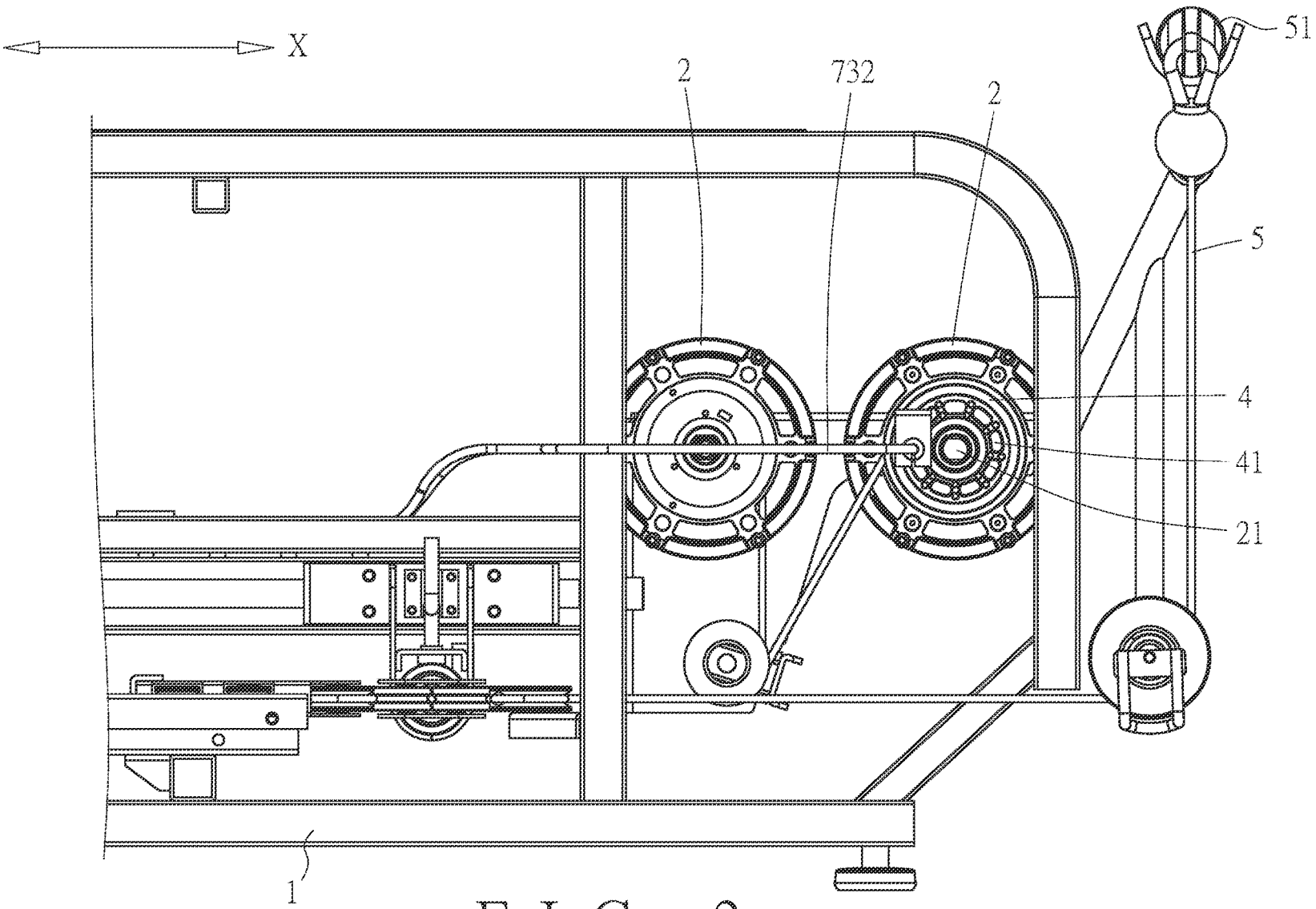
FIG. 2 is a partial, enlarged side view according to the embodiment of the present invention.
Figure 3:
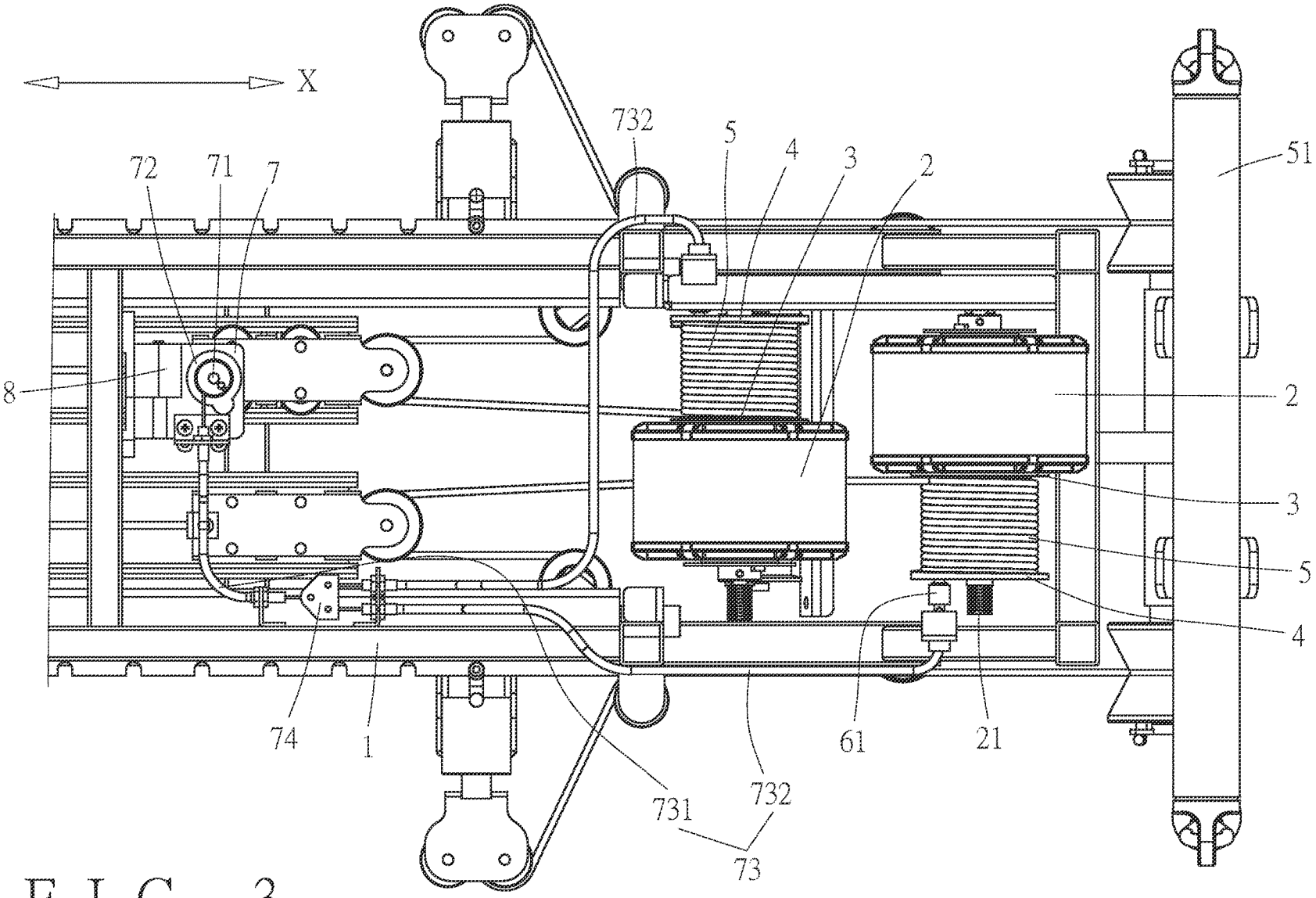
FIG. 3 is a schematic view showing the configuration of the resistance motor and the electric control unit according to the embodiment of the present invention.

FIG. 1, FIG. 2 and FIG. 3 illustrate an embodiment of the present invention comprises a frame 1, a resistance motor 2, a rotary disk 3, a locking disk 4, a traction member 5, a locking bolt 6, an electric control unit 7, and a power storage unit 8.

The frame 1 extends in a transverse direction X. The frame 1 includes a seat portion 11. The seat portion 1 extends in the transverse direction X. The seat portion 11 includes a first pad 111 and a second pad 112. The first pad 111 and the second pad 112 are adjustable and can be lifted and positioned in a multi-stage manner.

The resistance motor 2 is fixed to the frame 1. The resistance motor 2 has an output shaft 21 for outputting a resistance force. The embodiment of the present invention includes two resistance motors 2. The two resistance motors 2 are arranged at one end of the frame 1 in opposite directions.

Figure 4:
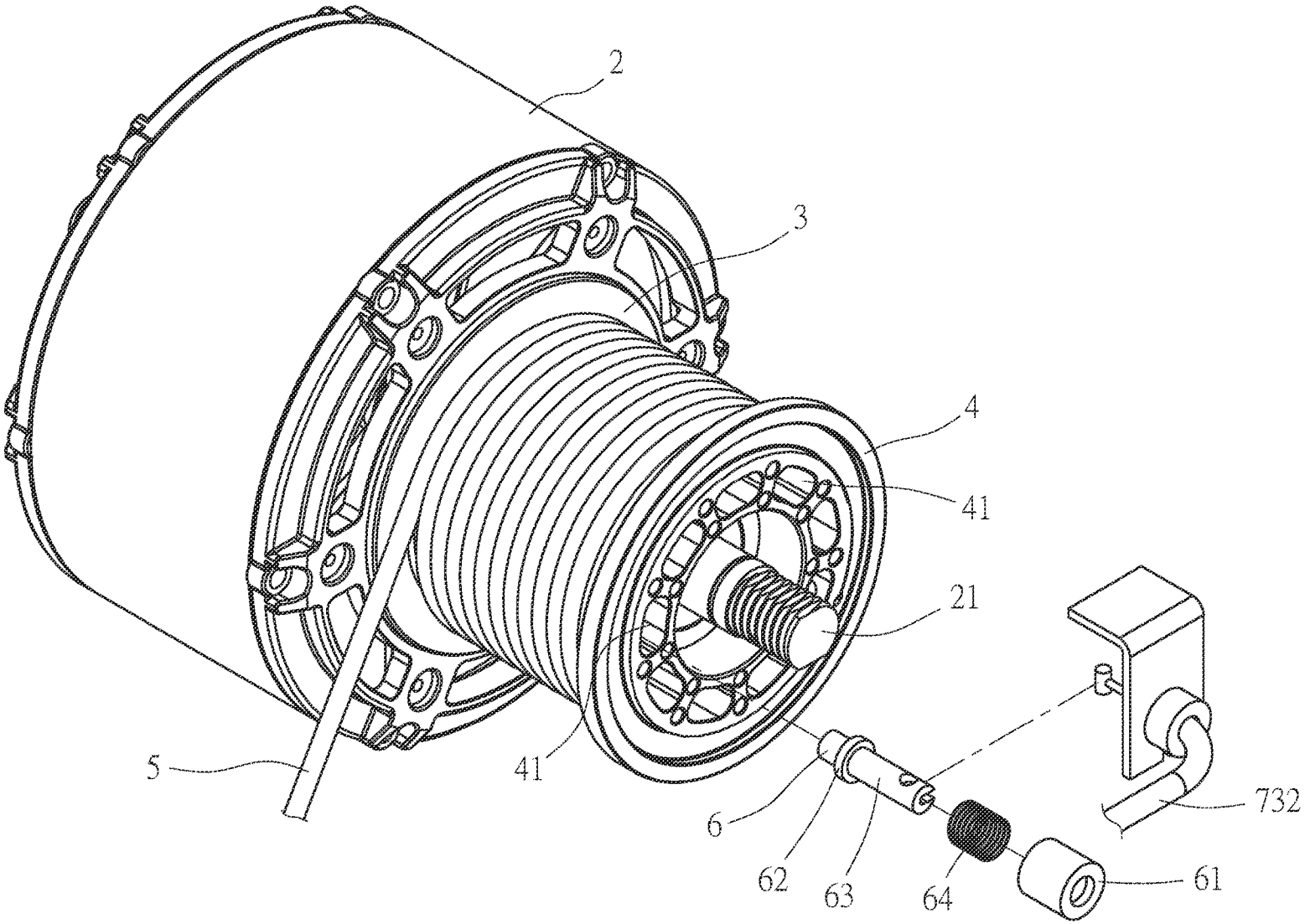
FIG. 4 is an exploded view of the locking disk and the locking bolt according to the embodiment of the present invention.

The rotary disk 3, as shown in FIG. 4, is connected to the output shaft 21 of the resistance motor 2.

The locking disk 4 is connected to the output shaft 21 of the resistance motor 2. The locking disk 4 may be independently coupled to one side of the rotary disk 3 or integrally formed with the side of the rotary disk 3. As shown in FIG. 4, one side of the locking disk 4 has a plurality of locking spaces 41. The locking spaces 41 may be axial through holes of the locking disk 4 or grooves formed on the circumference of the locking disk 4. The locking spaces 41 are arranged on the locking disk 4 around the output shaft 21.

One end of the traction member 5 is connected to the rotary disk 3, and the other end of the traction member 5 is connected to a grip 51. The traction member 5 is coiled on the rotary disk 3. The traction member 5 may be a pull cable, a webbing or a pull rope for holding by hand on the grip 51. Through the traction member 5 to pull the rotary disk 3, a force is applied to the traction member 5 to overcome the resistance force, so as achieve the effect of strength training.

Figure 5:
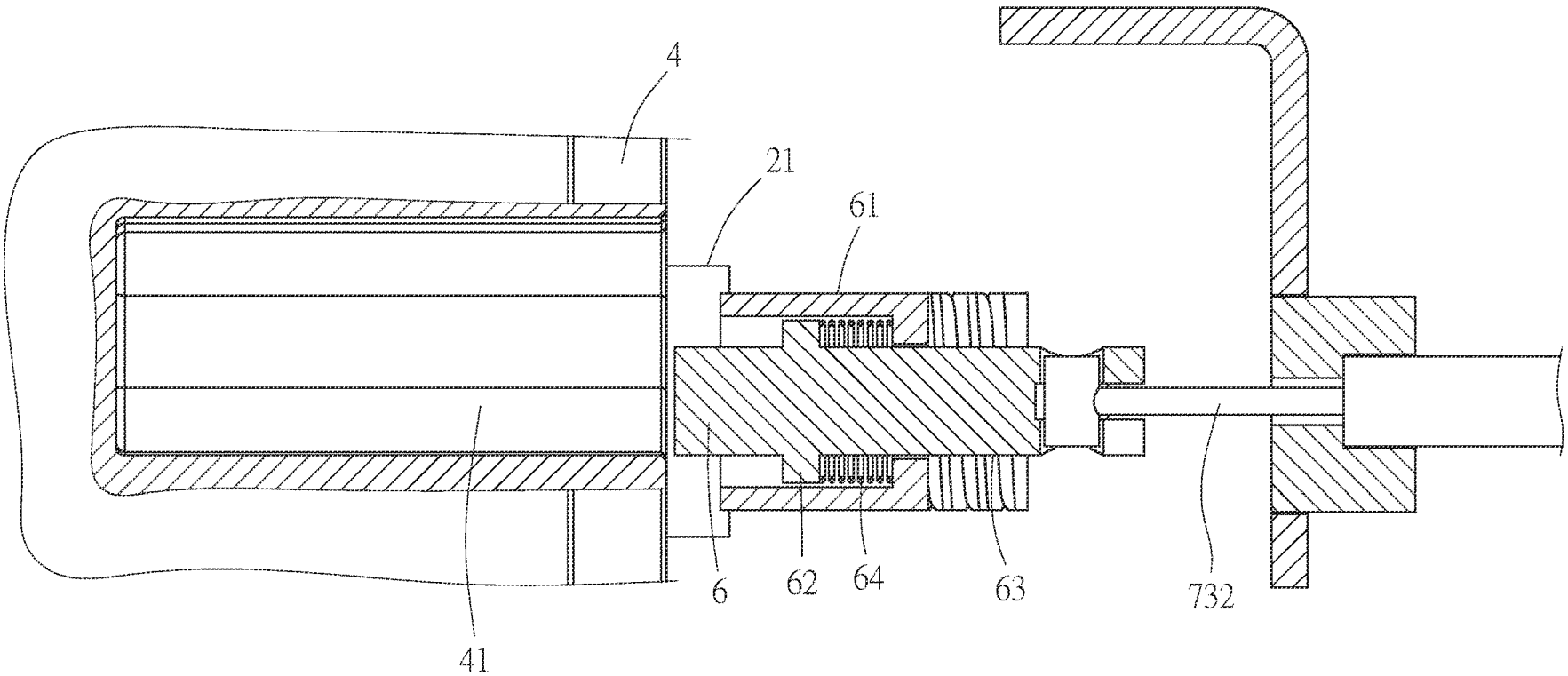
FIG. 5 is a schematic view according to the embodiment of the present invention, wherein the locking bolt is moved out of the locking space.

The locking bolt 6, as shown in FIG. 5, is disposed in a retaining seat 61. The locking bolt 6 includes a stop ring 62 fitted on the periphery of the locking bolt 6 and a return spring 64 on a rear section 63 of the locking bolt 6 behind the stop ring 62. The return spring 64 is elastically held between the stop ring 62 and the inner wall of the retaining seat 61. The retaining seat 61 is fixed to the frame 1. The locking bolt 6 is parallel to the output shaft 21.

Figure 6:
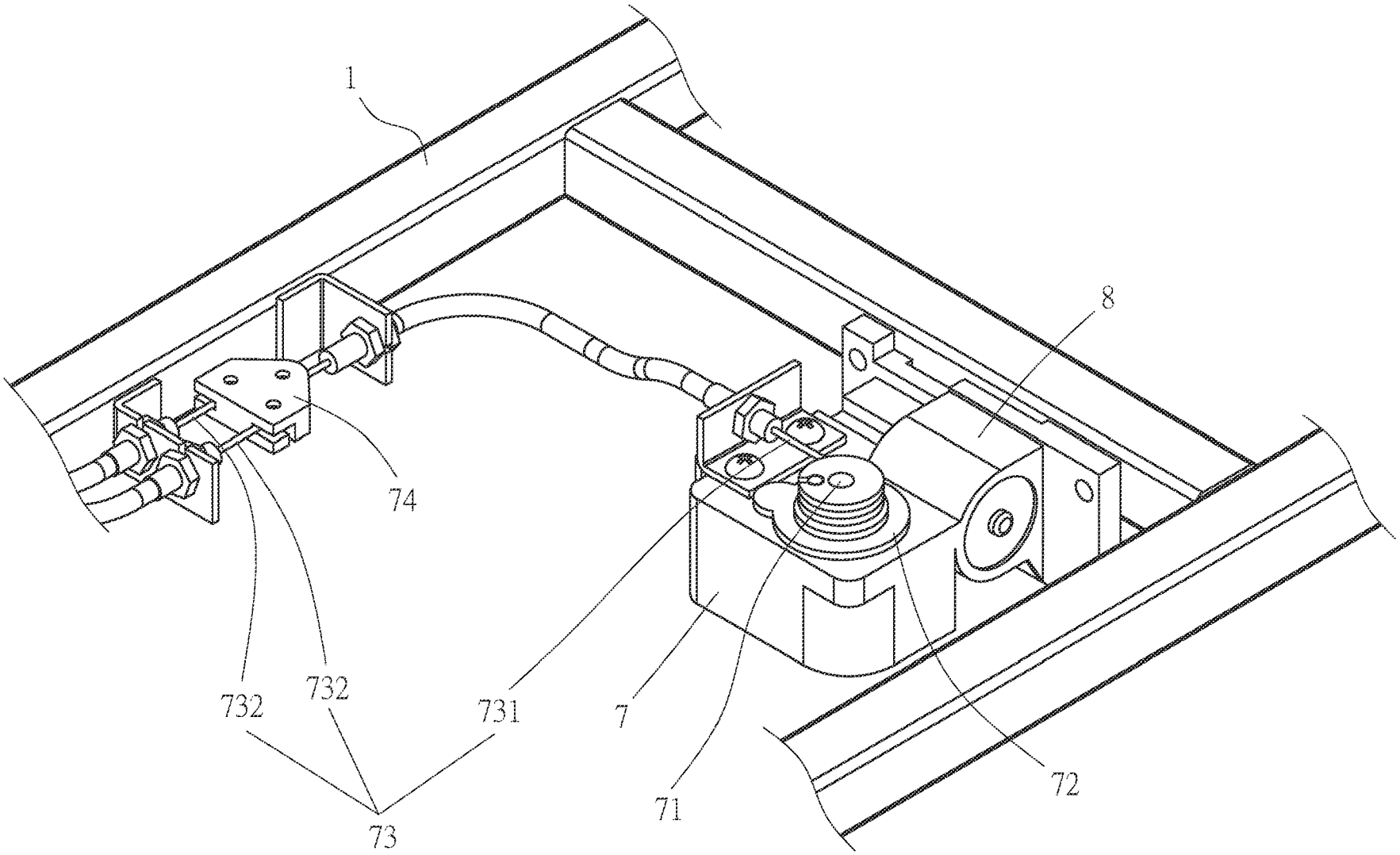
FIG. 6 is a schematic view showing the structure of the electric control unit according to the embodiment of the present invention.

The electric control unit 7 is connected to the locking bolt 6. The electric control unit 7 is a control motor or a solenoid valve. In the embodiment of the present invention, the control motor is taken as an example. As shown in FIG. 6, the electric control unit 7 includes an axle 71, a control disk 72 fixed to the axle 71, and a cable 73. The control disk 72 is connected to the locking bolt 6 through the cable 73. The cable 73 includes a first cable 731 and two second cables 732. One end of the first cable 731 is connected to the control disk 72. One end of the second cable 732 is connected to the rear section 63 of the locking bolt 6. The other end of the first cable 731 and the other end of the second cable are oppositely connected to a linking block 74, respectively. Since the embodiment of the present invention has two resistance motors 2, two rotary disks 3, two locking disks 4, two traction members 5 and two locking bolts 6 are arranged, which are available for pulling by the left and right hands, either together or separately, for strength training. The two locking bolts 6 are connected to the two second cables 732, respectively. The first cable 731 and the second cable 732 are steel cables. When the resistance motor 2 is stationary, the electric control unit 7 selectively moves the locking bolt 6 to be in or out of any one of the locking spaces 41 for restricting or releasing the output shaft to lock or unlock the resistance motor 2.

The power storage unit 8 is fixed to the frame 1. The power storage unit 8 is electrically connected to the electric control unit 7 for supplying the power needed to energize and actuate the electronic control unit 7.

Figure 7:
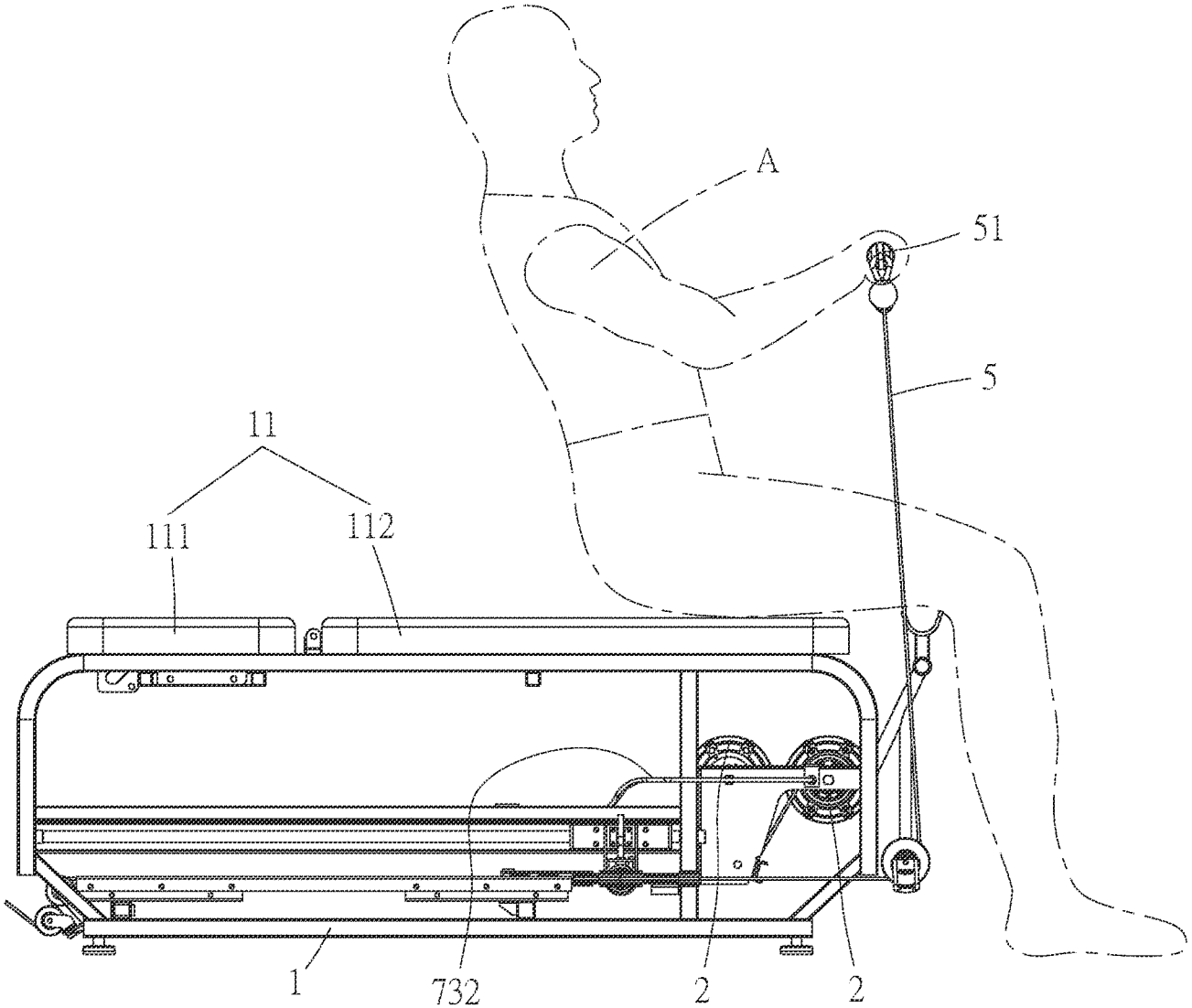
FIG. 7 is a schematic view according to the embodiment of the present invention when in use.

In use, as shown in FIG. 1, FIG. 2, and FIG. 3, first, the electric control unit 7 and the resistance motor 2 are actuated. By actuating the electric control unit 7 after being energized, the power storage unit 8 supplies power to the electric control unit 7, so that the axle 71 of the electric control unit 7 starts to rotate to generate a pulling force to bring the control disk 72 to reel in the first cable 731. Then, the first cable 731 links the second cables 732 to pull the respective locking bolts 6 through the linking block 74, as shown in FIG. 4 and FIG. 5, such that the stop ring 62 of the locking bolt 6 elastically compresses the return spring 64 to accumulate an elastic restoring force to retract the locking bolt 6 to the retaining seat 61. In this way, the locking bolt 6 is moved out of any one of the locking spaces 41 of the locking disk 4 to release the output shaft 21 for the resistance motor 2 to be in an unlocked state. After the resistance motor 2 is actuated, the output shaft 21 of the resistance motor 2 outputs a resistance force. The resistance force is fed back to the grip 51 via the traction member 5. As shown in FIG. 7, a user A sits on the seat portion 11 and holds the grip 51 with one or both hands, and then pulls the traction member 5 to overcome the resistance force, thereby doing a weight training exercise for hands.

When training is not required, as shown in FIG. 1, FIG. 2, and FIG. 3, the electric control unit 7 and the resistance motor 2 are turned off to interrupt the power supply of the power storage unit 8 to the electric control unit 7. By stopping the electric control unit 7 after power failure, the axle 71 of the electric control unit 7 stops rotating and outputting the pulling force. After the pulling force disappears, the control disk 72 is no longer driven, and the first cable 731 is in a loose state. At the same time, the two second cables 732 are loosened through the linking block 74.

Figure 8:
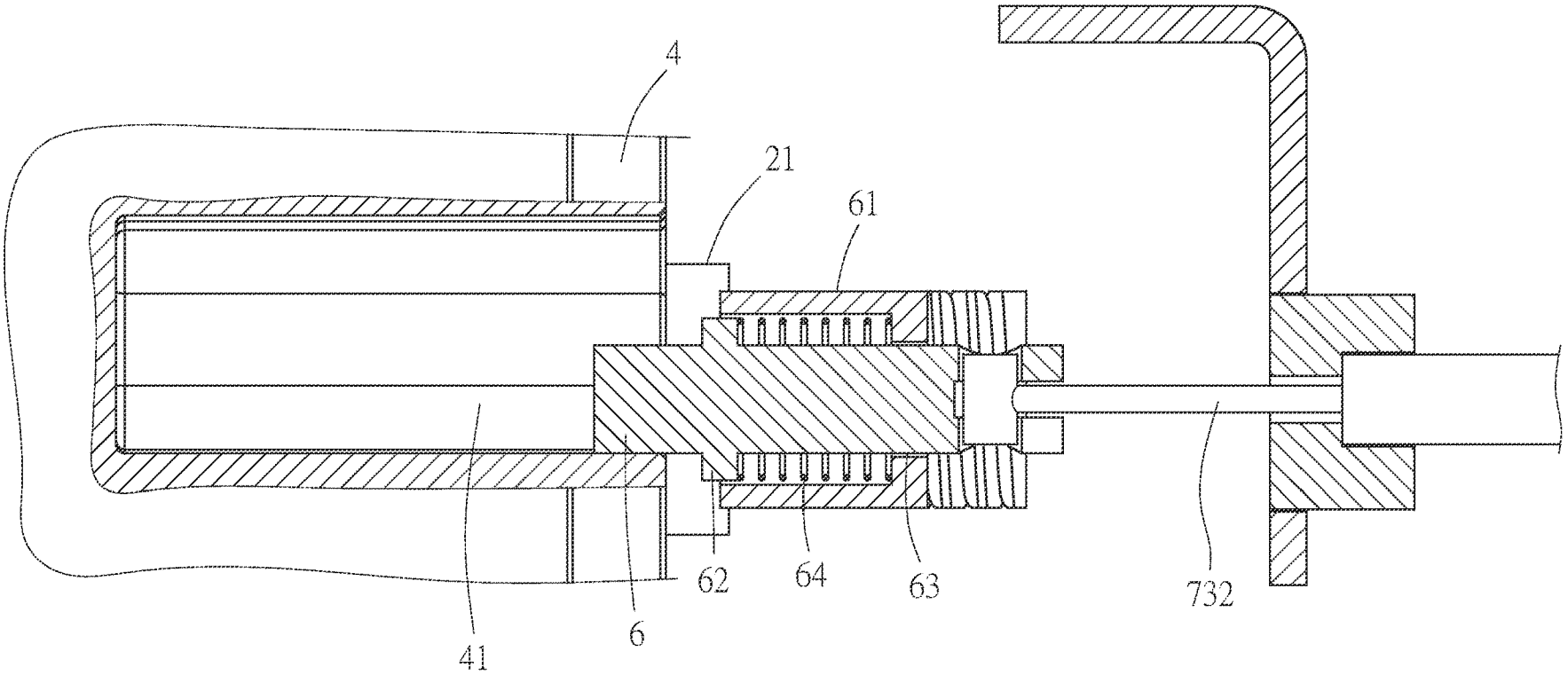
FIG. 8 is a schematic view according to the embodiment of the present invention, wherein the locking bolt is engaged in the locking space.

Since the second cables 732 are no longer affected by the pulling force, the locking bolt 6 will no longer be pulled. The locking bolt 6 can release the elastic restoring force through the return spring 64. As shown in FIG. 8, the locking bolt 6 is moved out of the retaining seat 61 to be engaged in any one of the locking spaces 41 of the locking disk 4. The locking disk 4 is locked by the locking bolt 6 to restrict the rotation of the output shaft 21, so the resistance motor 2 is in a locked state. Thus, the output shaft 21 of the resistance motor 2 cannot rotate. Even if the resistance motor 2 does not output the resistance force, the user A cannot pull the traction member 5 by holding the grip 51. Therefore, when the resistance motor 2 is stopped and stationary, the traction member 5 will not be pulled out arbitrarily, without the disadvantage of not being able to be retracted. Besides, it will not be pulled out in such a way as to cause obstruction or disturbance.

As shown in FIG. 6, the present invention uses a single electric control unit 7. Through the linkage of the linking block 74, one first cable 731 can link two or more second cables 732. Therefore, the number of linking components can be effectively reduced, so that the overall structure can be simplified. In addition, the power storage unit 8 with small current supplies the power required for the operation of the electric control unit 7. Therefore, it is extremely energy efficient and easy to operate.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An electric locking structure for a resistance motor of an exercise machine, the exercise machine including: a frame, at least one resistance motor, a traction member, an electric control unit, and a power storage unit, the at least one resistance motor being fixed to the frame and having an output shaft for outputting a resistance force, and the electric locking structure for each of the at least one resistance motor, comprising:

a rotary disk connected to the output shaft, wherein the traction member is coiled on the rotary disk for pulling of the rotary disk by a user of the exercise machine to overcome the resistance force output by the output shaft;

a locking disk connected to the output shaft and being formed with a plurality of locking spaces, wherein each of the plurality of locking spaces is an axial through hole extending parallel with respect to the output shaft; and a locking bolt movably disposed on the frame;

wherein the electric control unit is connected to the locking bolt associated with the at least one resistance motor;

wherein the power storage unit is electrically connected to the electric control unit; and wherein when the at least one resistance motor is stationary, the electric control unit selectively moves the locking bolt associated with the at least one resistance motor to extend into or be out of one of the plurality of locking spaces of the locking disk for either of restricting or releasing the output shaft to either one of lock or unlock the at least one resistance motor, thereby said locking bolt extending into a selective one of the plurality of locking spaces of the locking disk positively locks the locking disk.

2. The electric locking structure as claimed in claim 1, wherein the electric control unit is either one of a control motor or a solenoid valve.

3. The electric locking structure as claimed in claim 2, wherein the electric control unit includes an axle, a control disk fixed to the axle, and a cable extending between the control disk and the locking bolt associated with the at least one resistance motor, wherein the control disk is connected to the locking bolt associated with the at least one resistance motor through the cable for moving the locking bolt associated with the at least one resistance motor to extend into or be out of a selective one of the plurality of locking spaces of the locking disk.

4. The electric locking structure as claimed in claim 3, wherein the locking bolt associated with the at least one resistance motor is disposed in a retaining seat and the retaining seat is fixed to the frame, and wherein a stop ring is fitted on an outer periphery of the locking bolt associated with the at least one resistance motor and a return spring is disposed on said locking bolt for being held against a surface of the stop ring facing away from the locking disk, and thereby the return spring being elastically held between the stop ring and an inner wall of the retaining seat.

5. The electric locking structure as claimed in claim 4, further comprising two resistance motors, and wherein the cable includes a first cable and two second cables, wherein one of two ends of the first cable is connected to the control disk and one end of each of the two second cables is connected to an end of the locking bolt associated with a corresponding one of the at least one resistance motor of the two resistance motors facing away from the locking disk, and another end of each of the two second cables and a corresponding one of the two ends of the first cable are connected in opposing relationship to a linking block.

6. The electric locking structure as claimed in claim 1, wherein the locking bolt associated with the at least one resistance motor extends parallel with respect to the output shaft.

7. The electric locking structure as claimed in claim 1, wherein the locking disk is either one of independently coupled to the rotary disk or is integrally formed with the rotary disk.

8. The electric locking structure as claimed in claim 1, wherein the plurality of locking spaces are arranged on the locking disk around the output shaft.

9. The electric locking structure as claimed in claim 1, wherein the traction member is either one of a pull cable, a webbing, or a pull rope.

10. An electric locking structure for a resistance motor of an exercise machine, the exercise machine including a frame, at least one resistance motor, a traction member, an electric control unit, and a power storage unit, the at least one resistance motor being fixed to the frame and having an output shaft for outputting a resistance force, and the electric locking structure for each of the at least one resistance motor, comprising:

a rotary disk connected to the output shaft, wherein the traction member is coiled on the rotary disk for pulling of the rotary disk by a user of the exercise machine to overcome the resistance force output by the output shaft;

a locking disk connected to the output shaft and being formed with a plurality of locking spaces; and a locking bolt movably disposed on the frame;

wherein the electric control unit is connected to the locking bolt associated with the at least one resistance motor and the electric control unit is either one of a control motor or a solenoid valve, the electric control unit including an axle, a control disk fixed to the axle, and a cable extending between the control disk and the locking bolt associated with the at least one resistance motor, wherein the control disk is connected to the locking bolt associated with the at least one resistance motor through the cable;

wherein the power storage unit is electrically connected to the electric control unit; and wherein when the at least one resistance motor is stationary and through the connection between the control disk and the locking bolt associated with the at least one resistance motor via the cable, the electric control unit moves the locking bolt associated with the at least one resistance motor to extend into or be out of a selective one of the plurality of locking spaces of the locking disk for either of restricting or releasing the output shaft to either one of lock or unlock the at least one resistance motor.

11. The electric locking structure as claimed in claim 10, wherein the locking bolt associated with the at least one resistance motor is disposed in a retaining seat and the retaining seat is fixed to the frame, and wherein a stop ring is fitted on an outer periphery of the locking bolt associated with the at least one resistance motor and a return spring is disposed on said locking bolt for being held against a surface of the stop ring facing away from the locking disk, and thereby the return spring being elastically held between the stop ring and an inner wall of the retaining seat.

12. The electric locking structure as claimed in claim 11, further comprising two resistance motors, and wherein the cable includes a first cable and two second cables, wherein one of two ends of the first cable is connected to the control disk and one end of each of the two second cables is connected to an end of the locking bolt associated with a corresponding one of the at least one resistance motor of the two resistance motors facing away from the locking disk, and another end of each of the two second cables and a corresponding one of the two ends of the first cable are connected in opposing relationship to a linking block.

13. The electric locking structure as claimed in claim 10, wherein the locking bolt associated with the at least one resistance motor extends parallel with respect to the output shaft.

14. The electric locking structure as claimed in claim 10, wherein the locking disk is either one of independently coupled to the rotary disk or is integrally formed with the rotary disk.

15. The electric locking structure as claimed in claim 10, wherein each of the plurality of locking spaces is either an axial through hole or is a groove formed at a corresponding circumferential portion of the locking disk.

16. The electric locking structure as claimed in claim 10, wherein the plurality of locking spaces are arranged on the locking disk around the output shaft.

17. The electric locking structure as claimed in claim 10, wherein the traction member is either one of a pull cable, a webbing, or a pull rope.

* * * * *